US008727884B2

(12) United States Patent
Gagner et al.

(10) Patent No.: US 8,727,884 B2
(45) Date of Patent: May 20, 2014

(54) WAGERING GAME HISTORY FEATURES

(75) Inventors: Mark B. Gagner, West Chicago, IL (US); Damon E. Gura, Chicago, IL (US); Erhard W. Rathsack, Reno, NV (US)

(73) Assignee: WMS Gaming, Inc., Waukegan, IL (US)

( * ) Notice: Subject to any disclaimer, the term of this patent is extended or adjusted under 35 U.S.C. 154(b) by 622 days.

(21) Appl. No.: 12/670,818

(22) PCT Filed: Jul. 31, 2008

(86) PCT No.: PCT/US2008/071856

§ 371 (c)(1),
(2), (4) Date: Jan. 26, 2010

(87) PCT Pub. No.: WO2009/020843

PCT Pub. Date: Feb. 12, 2009

(65) Prior Publication Data

US 2010/0190554 A1 Jul. 29, 2010

Related U.S. Application Data

(60) Provisional application No. 60/953,727, filed on Aug. 3, 2007.

(51) Int. Cl.
*A63F 9/24* (2006.01)

(52) U.S. Cl.
USPC ..... 463/42; 463/43; 463/25

(58) Field of Classification Search
None
See application file for complete search history.

(56) References Cited

U.S. PATENT DOCUMENTS

| | | | | |
|---|---|---|---|---|
| 5,573,244 | A | 11/1996 | Mindes | |
| 5,842,921 | A | 12/1998 | Mindes et al. | |
| 6,846,238 | B2 * | 1/2005 | Wells | 463/39 |
| 6,918,831 | B2 * | 7/2005 | Nguyen et al. | 463/20 |
| 7,048,629 | B2 | 5/2006 | Sines et al. | |
| 7,384,339 | B2 * | 6/2008 | LeMay et al. | 463/30 |
| 2001/0046893 | A1 * | 11/2001 | Giobbi et al. | 463/24 |
| 2003/0003997 | A1 | 1/2003 | Vuong et al. | |
| 2003/0064805 | A1 * | 4/2003 | Wells | 463/39 |
| 2004/0147314 | A1 * | 7/2004 | LeMay et al. | 463/30 |
| 2005/0193209 | A1 * | 9/2005 | Saunders et al. | 713/182 |
| 2006/0178188 | A1 | 8/2006 | LeMay et al. | |
| 2007/0202941 | A1 * | 8/2007 | Miltenberger et al. | 463/25 |
| 2008/0039207 | A1 * | 2/2008 | Hutchinson-Kay | 463/42 |
| 2008/0045289 | A1 * | 2/2008 | Odom et al. | 463/16 |
| 2009/0275377 | A1 | 11/2009 | Anderson et al. | |

OTHER PUBLICATIONS

PCT Application No. PCT/US2007/078210 International Preliminary Report on Patentability, Mar. 9, 2009 , 10 pages.

(Continued)

*Primary Examiner* — David L Lewis
*Assistant Examiner* — Shauna-Kay Hall
(74) *Attorney, Agent, or Firm* — DeLizio Gilliam, PLLC

(57) ABSTRACT

This description describes techniques for storing and utilizing wagering game histories. In one embodiment, a method for recording progress of a wagering game can include detecting a first event indicating a first activity of the wagering game. The method can also include storing the first event according to a first data format and detecting a second event indicating a second activity of the wagering game, wherein the second event includes random number information indicating a result of the wagering game. The method can also include encrypting the second event and storing the second event according to the first data format.

19 Claims, 12 Drawing Sheets

(56) References Cited

OTHER PUBLICATIONS

PCT Application No. PCT/US2007/078210 International Search Report, Jun. 5, 2008 , 7 pages.
PCT Application No. PCT/US2008/71856 International Search Report, Jan. 2, 2009 , 9 pages.
U.S. Appl. No. 12/441,340 Office Action, Jul. 12, 2011 , 14 pages.
PCT Application No. PCT/US2008/71856 International Preliminary Report on Patentability, Aug. 5, 2010 , 11 pages.
U.S. Appl. No. 12/441,340 Final Office Action, Dec. 23, 2011 , 13 pages.
U.S. Appl. No. 12/441,340 Office Action, Nov. 26, 2012 , 14 pages.

* cited by examiner

WAGERING GAME HISTORY FEATURES

RELATED APPLICATIONS

This application claims the priority benefit of U.S. Provisional Application Ser. No. 60/953,727 filed Aug. 3, 2007.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2008, WMS Gaming, Inc.

FIELD

Embodiments of the inventive subject matter relate generally to wagering game systems, and more particularly to reporting and using wagering game events in wagering game systems.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

In some embodiments, a method for recording progress of a wagering game comprises detecting a first event indicating a first activity of the wagering game; storing the first event according to a first data format; detecting a second event indicating a second activity of the wagering game, wherein the second event includes random number information indicating a result of the wagering game; encrypting the second event; and storing the second event according to the first data format.

In some embodiments, the method further comprises detecting a third event indicating completion of the wagering game; after detecting the third event, decrypting the first event; and converting the first event, the second event, and the third event into a compressed data format.

In some embodiments, events in the first data format and events in the compressed data format are stored in different data stores.

In some embodiments, the first event indicates one or more wagering game activities selected from the group consisting of a wager, a game element selection, and a game invocation.

In some embodiments, the first data format is a clear text format.

In some embodiments, the second data format requires less storage space than the first data format.

In some embodiments, events in the first data format are in a native database format, and wherein events in the second data format are in an archival format.

In some embodiments, a machine-readable medium includes instructions executable by a machine. In some embodiments, the instructions for initiating a wagering game session comprise instructions for receiving a player account identifier and one or more authentication credentials; instructions for contemporaneously verifying the authentication credentials and determining there is an unfinished wagering game associated with the player account identifier; and instructions for procuring one or more events, wherein the one or more events include information for resuming the unfinished wagering game.

In some embodiments, the instructions further comprise instructions for presenting a result for the unfinished wagering game.

In some embodiments, the one or more events indicate a result for the unfinished wagering game.

In some embodiments, the instructions further comprise instructions for transmitting, to a wagering game machine, the one or more events for use in presenting a result for the unfinished wagering game.

In some embodiments, the instructions further comprise instructions for determining other results for additional wagering games.

In some embodiments, the events indicate player inputs that have been detected and content that has been presented.

In some embodiments, a wagering game network comprises a wagering game machine configured to report events associated with a wagering game and a player account; a wagering game server configured to generate random number information in response to one or more of the events, wherein the random number information indicates a result for the wagering game; a game history server including, an event recorder configured to record the events and the random number information; and a wagering game resolution unit configured to determine, based on the events, that a result of the wagering game has been determined but not presented, and to cause modification of a balance of the player account based on the result.

In some embodiments, the wagering game server and game history server are included in a single server system.

In some embodiments, the wagering game server and game history server are separate devices of the wagering game network.

In some embodiments, the wagering game network further comprises an account server configured to perform the modification of the balance of the player account.

In some embodiments, the events indicate one or more selected from the set consisting of a wager, a game element selection, and a game invocation.

In some embodiments, the wagering game machine is a mobile model.

In some embodiments, the game history sever is further configured to encrypt the random number information.

BRIEF DESCRIPTION OF THE FIGURES

The present invention is illustrated by way of example and not limitation in the Figures of the accompanying drawings in which.

DESCRIPTION OF THE EMBODIMENTS

Techniques for reporting and utilizing wagering game events are described herein. This description of the embodiments is divided into five sections. The first section introduces some embodiments of the invention. The second section describes an operating environment, while the third section describes operations performed in some embodiments of the operating environment. The fourth section describes wagering game machines in more detail and the fifth section provides some general comments.

Introduction

Wagering game machines sometimes experience conditions that interrupt wagering games before completion. For example, during a slots game, a wagering game machine may loose power before completing the reel spin. While power loss may be one cause for interruption, interruptions can result from power surges, hardware faults, software faults, external factors (e.g., physical impacts, water, etc), etc. Some conditions interrupt mobile wagering game machines ("mobile machines"), but not stationary cabinet-style wagering game machines ("stationary machines"). For instance, in some mobile gaming environments, casinos require that players remain in designated casino areas, such as in a sports book, restaurant, or swimming pool area. If players carry mobile machines outside the designated areas, the mobile machines may immediately shut-down, interrupting games in progress.

According to some embodiments of the invention, game history servers record events that indicate the progress of wagering games. The events can indicate button presses, bets, intermediate game results, final game results, etc. The game history servers can store and use the events to reconstruct wagering games to pre-interruption states. Additionally, if players dispute game results, casino attendants can use the events to replay games and verify results. For security, the game history servers can encrypt some events, such as events indicating intermediate and final game results. For efficiency, after a wagering game is complete, the game history servers can compress the game's events into a more compact format.

The following sections describe these and other embodiments in greater detail.

Operating Environment

This section describes an example operating environment and provides structural aspects of some embodiments. In particular, this section describes wagering game networks, various servers, and wagering game machines.

Wagering Game Networks

Figure 1:
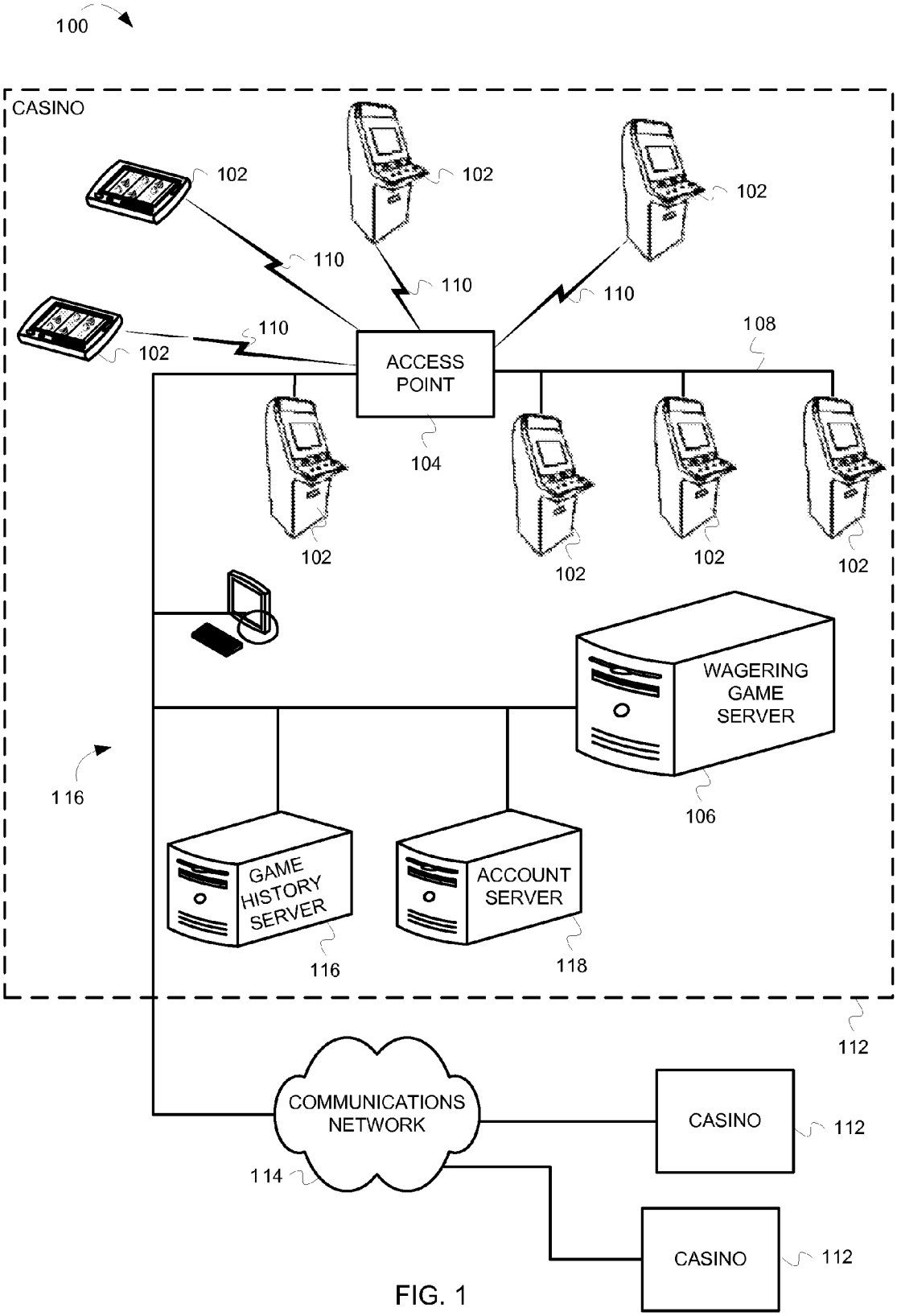
FIG. 1 is a block diagram illustrating a wagering game network, according to example embodiments of the invention.

FIG. 1 is a block diagram illustrating a wagering game network, according to example embodiments of the invention. As shown in FIG. 1, the wagering game network 100 includes a communications network 114 connected to a plurality of casinos 112. Each casino 112 includes a local area network 116, which includes an access point 104, a wagering game server 106, wagering game history server 116, account server 118, and wagering game machines 102.

The access point 104 provides wireless communication links 110 and wired communication links 108. The wired and wireless communication links can employ any suitable connection technology, such as Bluetooth, 802.11g, Ethernet, public switched telephone networks, SONET, etc.

In some embodiments, the wagering game server 106 can serve wagering games and distribute content to devices (e.g., mobile machines) located in the casino 112 or at other locations on the communications network 114. As the wagering game server 106 serves wagering games, it can utilize the account server's account services and report events to the game history server ("history server") 116. As noted above, the events can indicate progress and state of wagering games. The history server 116 can store the events for later use in replaying games, verifying games, etc. In some embodiments, the history server 116 encrypts some events (e.g., events that indicate intermediate or final game results). In some embodiments, the history server 116 stores a wagering game's events in an uncompressed normalized format before the wagering game is complete. After completion, the history server 116 can compress the events into a compact format that occupies less storage space.

The wagering game server 106 and other devices can use the account server 118 to electronically fund wagering games, deposit winnings, transfer monies, etc. In some embodiments, the account server 118 verifies player login credentials before allowing devices to conduct account transactions. Additionally, the account server 118 can record player activities, such as games played, game selections, velocity of play, etc.

The wagering game machines 102 described herein can take any suitable form, such as stationary floor models, handheld mobile models, bartop models, workstation-type console models, etc. Further, the wagering game machines 102 can be primarily dedicated for use in conducting wagering games, or can include non-dedicated devices, such as mobile phones, personal digital assistants, personal computers, etc.

In some embodiments, wagering game machines 102 and wagering game servers 106 work together such that a wagering game machine 102 can be operated as a thin, thick, or intermediate client. For example, one or more elements of game play may be controlled by the wagering game machine 102 (client) or the wagering game server 106 (server). Game play elements can include executable game code, lookup tables, configuration files, game outcome, audio or visual representations of the game, game assets or the like. In a thin-client example, the wagering game server 106 can perform functions such as determining game outcome or managing assets, while the wagering game machine 102 can present a graphical representation of such outcome or asset modification to the user (e.g., player). In a thick-client example, the wagering game machines 102 can determine game outcomes and communicate the outcomes to the wagering game server 106 for recording or managing a player's account.

In some embodiments, either the wagering game machines 102 (client) or the wagering game server 106 can provide functionality that is not directly related to game play. For example, account transactions and account rules may be managed centrally (e.g., by the wagering game server 106) or locally (e.g., by the wagering game machine 102). Other functionality not directly related to game play may include power management, presentation of advertising, software or firmware updates, system quality or security checks, etc. Any of the wagering game network components (e.g., the wagering game machines 102) can include hardware and machine-readable media including instructions for performing the operations described herein. The wagering game network 100 can also include other network devices, such as wide area progressive servers, wagering game maintenance servers, etc.

Wagering Game Network Servers

Figure 2:
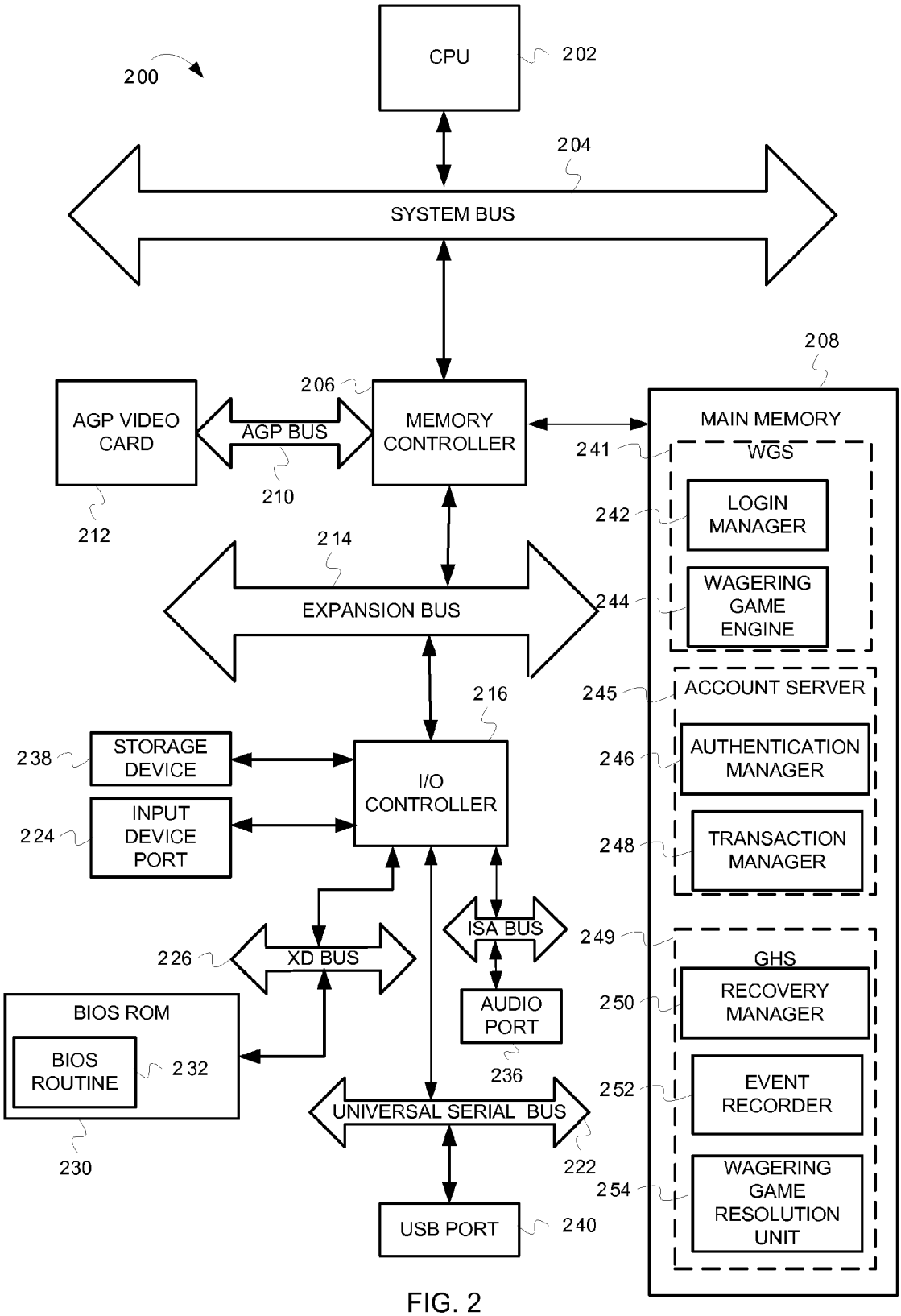
FIG. 2 is a block diagram illustrating a wagering game network server system, according to some embodiments of the invention.

FIG. 2 is a block diagram illustrating a wagering game network server system, according to some embodiments of the invention. In FIG. 2, a wagering game network server system ("server system") 200 includes a central processing unit 202 connected to a system bus 204. The system bus 204 is connected to a memory controller 206 (also called a north bridge), which is connected to a main memory 208, AGP bus 210 and AGP video card 212. The main memory 208 can include any suitable memory random access memory (RAM), such as synchronous dynamic RAM, extended data output RAM, etc.

The main memory 208 includes a wagering game server 241, account server 245, and game history server 249. While FIG. 1 shows the servers as independent machines on a wagering game network, FIG. 2 shows an embodiment in which all the servers reside in the server system 200. As shown, the wagering game server 241 includes a login manager 242 and wagering game engine 244. The account server 245 includes an authentication manager 246 and transaction manager 248. The game history server 249 includes a recovery manager 250, event recorder 252, and wagering game resolution unit 254. The event recorder 252 can include a relational database or other data store suitable for storing events. The operations of the servers 241, 245, & 249 are described in the next section.

An expansion bus 214 connects the memory controller 206 to an input/output (I/O) controller 216 (also called a south bridge). According to embodiments, the expansion bus 214 can be include a peripheral component interconnect (PCI) bus, PCIX bus, PC Card bus, CardBus bus, InfiniBand bus, or an industry standard architecture (ISA) bus, etc. The I/O controller is connected to input device ports 224 (e.g., keyboard port, mouse port, and joystick port), storage device 238 (e.g., hard disk drive), and a universal serial bus (USB) 222. The USB 222 is connected to a USB port 240. The I/O controller 216 is also connected to an XD bus 226 and an ISA bus 228. The ISA bus 228 is connected to an audio device port 236, while the XD bus 226 is connected to BIOS read only memory (ROM) 230.

In some embodiments, the server system 200 can include additional peripheral devices and/or more than one of each component shown in FIG. 2. For example, in some embodiments, the server system 200 can include multiple CPUs 202.

Wagering Game Machines

Figure 3:
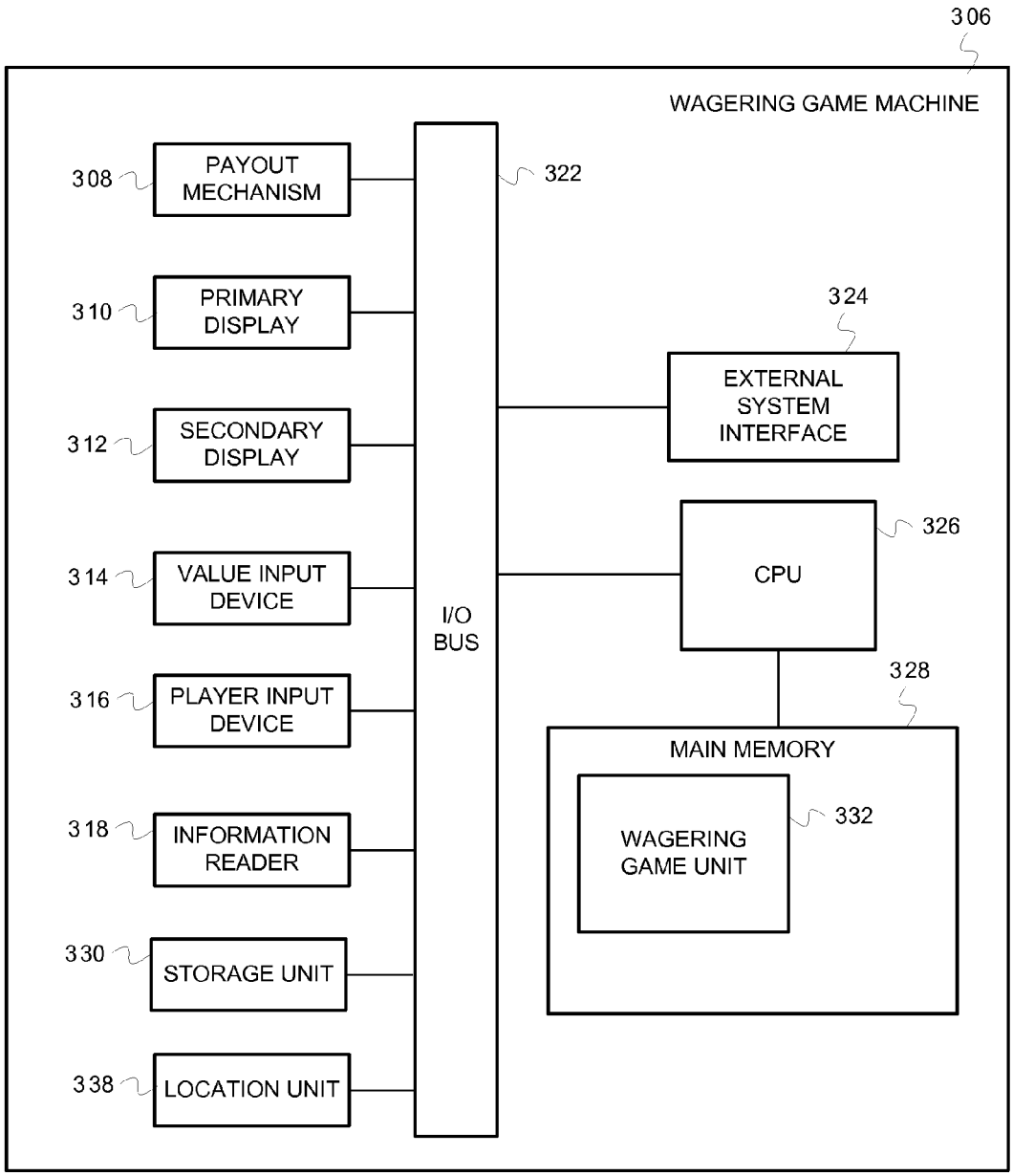
FIG. 3 is a block diagram illustrating a wagering game machine, according to example embodiments of the invention.

FIG. 3 is a block diagram illustrating a wagering game machine, according to example embodiments of the invention. The wagering game machine 306 can be implemented as a mobile machine, stationary machine, or any other suitable model. As shown in FIG. 3, the wagering game machine 306 includes a central processing unit (CPU) 326 connected to main memory 328. The CPU 326 can include any suitable processor, such as an Intel® Pentium processor, Intel® Core 2 Duo processor, AMD Opteron™ processor, or UltraSPARC processor. The main memory 328 includes a wagering game unit 332. In some embodiments, the wagering game unit 332 can present wagering games, such as video poker, video black jack, video slots, video lottery, etc., in whole or part. Additionally, the wagering game unit 332 can report and process wagering game events as further described herein.

The CPU 326 is connected to an input/output (I/O) bus 322, which can include any suitable bus technologies, such as an AGTL+frontside bus and a PCI backside bus. The I/O bus 322 is connected to a payout mechanism 308, primary display 310, secondary display 312, value input device 314, player input device 316, information reader 318, and storage unit 330. The player input device 316 can include the value input device 314 to the extent the player input device 316 is used to place wagers. The storage unit 330 includes a database 338 that can include sensitive wagering game data. The database 338 can include a relational database, flat file database, directory database, etc. The I/O bus 322 is also connected to an external system interface 324, which is connected to external systems 324 (e.g., wagering game networks).

The I/O bus 322 is also connected to a location unit 338. The location unit 338 can create player information that indicates the wagering game machine's location and movements in a casino. In some embodiments, the location unit 338 includes a global positioning system (GPS) receiver that can determine the wagering game machine's location using GPS satellites. In other embodiments, the location unit 338 can include a radio frequency identification (RFID) tag that can determine the wagering game machine's location using RFID readers positioned throughout a casino. In other embodiments, the location unit includes an RFID reader and the tags are positioned throughout a casino. Some embodiments can use GPS receiver and RFID tags in combination, while other embodiments can use other suitable methods for determining the wagering game machine's location. Although not shown in FIG. 3, in some embodiments, the location unit 338 is not connected to the I/O bus 322.

In one embodiment, the wagering game machine 306 can include additional peripheral devices and/or more than one of each component shown in FIG. 3. For example, in one embodiment, the wagering game machine 306 can include multiple external system interfaces 324 and/or multiple CPUs 326.

Any of the components described herein can be further integrated or divided. Furthermore, any of the components can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments of the invention. In the discussion below, the flow diagrams will be described with reference to the block diagrams presented above. However, in some embodiments, those operations can be performed by other components. In certain embodiments, the operations are performed by executing instructions residing on machine-readable media (e.g., software), while in other embodiments, the operations are performed by hardware and/or other logic (e.g., firmware). In some embodiments, the operations are performed in series, while in other embodiments, one or more of the operations can be performed in parallel. Moreover, some embodiments perform less than all the operations shown in the flow diagrams.

Conducting Wagering Games & Tracking Events

This subsection describes operations for conducting wagering games and tracking wagering game events ("events"). In some embodiments, wagering game machines, wagering game servers, account servers, and game history servers work together to conduct wagering games and track events. The following discussion will describe operations for each of these components and will refer to the figures presented above.

Figure 4:
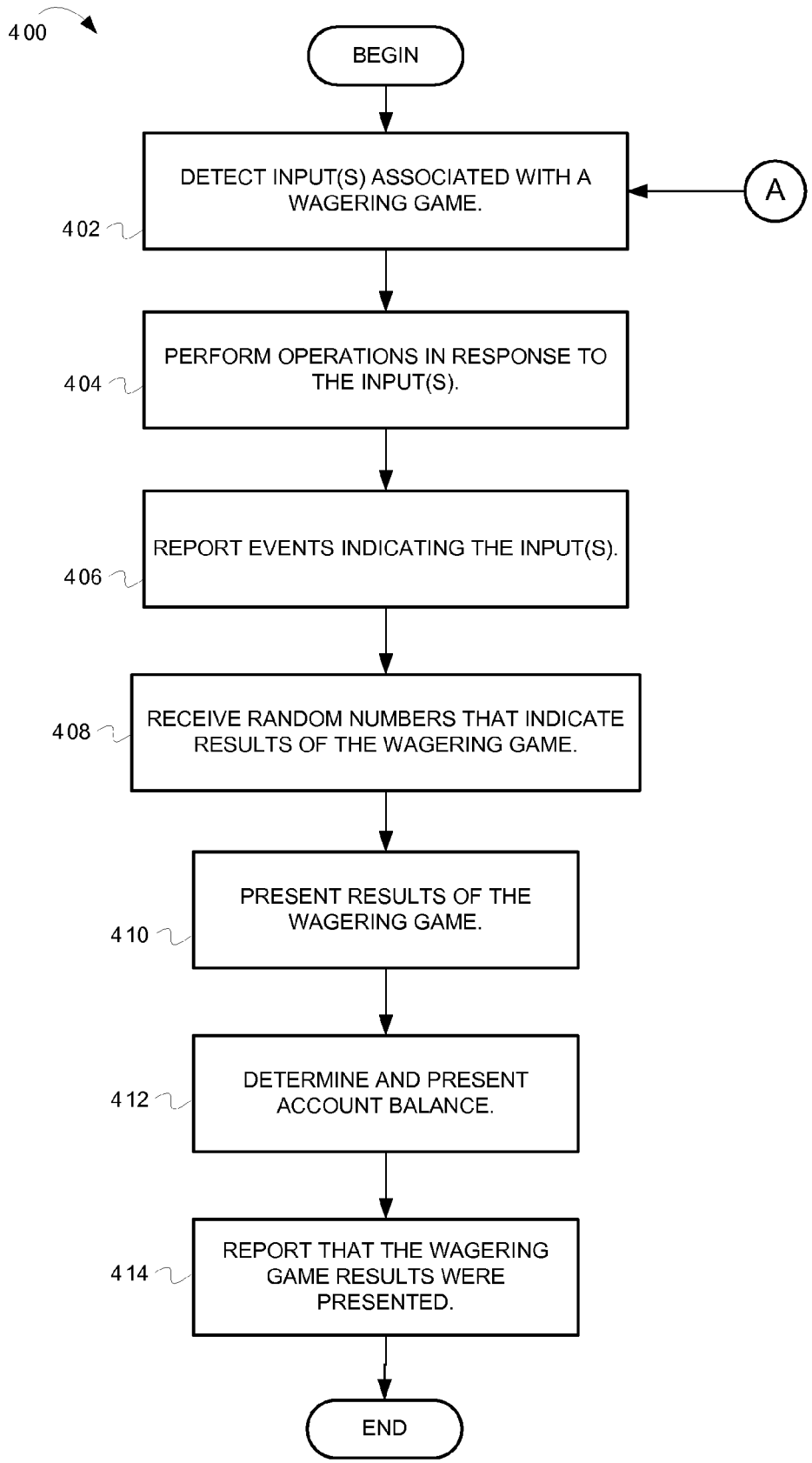
FIG. 4 is a flow diagram illustrating operations for presenting wagering games and reporting events on a mobile machine, according to some embodiments of the invention.

FIG. 4 is a flow diagram illustrating operations for presenting wagering games and reporting events on a mobile machine, according to some embodiments of the invention. In some embodiments, the mobile machine receives input and presents results associated with wagering games, while other network components determine game results, update account balances, and record game history. The mobile machine can also assist in tracking progress of wagering games by reporting what input has been received and what results have been presented. The flow 400 begins at block 402.

At block 402, a mobile machine's wagering game unit 332 detects input associated with the wagering game. For example, the wagering game unit 332 can detect that a player has entered wagering game input (e.g., bets, spin reels command, etc.) through a touchscreen on the primary display 310, buttons on the player input device 316, etc. The flow continues at block 404.

At block 404, the mobile machine's wagering game unit 332 performs operations in response to the input. For instance, in response to the input, the wagering game unit 332 can present certain output, such as graphically moving wagering game pieces, updating game meters, etc. Additionally, the wagering game unit 332 can exchange wagering game information with other network devices. The flow continues at block 406.

At block 406, the mobile machine's wagering game unit 332 reports events to the wagering game server 241, where the events indicate the input and operations associated with the wagering game. Although in FIG. 4 the reporting occurs after detecting input and performing operations, some embodiments report events each time input is detected and operations are performed. The flow continues at block 408.

At block 408, the wagering game unit 332 receives random number information that indicates results of the wagering game. In some embodiments, the mobile machine receives the random number information from the wagering game server 241. The random numbers can indicate where the reels will stop, what cards will be dealt, values for game elements, etc. The flow continues at block 410.

At block 410, the wagering game unit 332 presents results of the wagering game. For example, based on the random number information, the wagering game unit 332 graphically presents results for the wagering game. The graphical presentation can include spending reels, flipping cards, revealing prizes, etc. The flow continues at block 412.

At block 412, the wagering game unit 332 determines and presents an updated player account balance. In some embodiments, the wagering game unit 332 contacts the wagering game server 241 or the account server 245 to obtain the account balance resulting from the wagering game. The flow continues at block 414.

At block 414, the mobile machine's wagering game unit 332 reports an event indicating that the wagering game results were presented. The wagering game unit 332 can report the event to the game history server 249 and/or the wagering game server 241. In some embodiments, after the results are presented, the wagering game is complete. From block 414, the flow ends.

Figure 5:
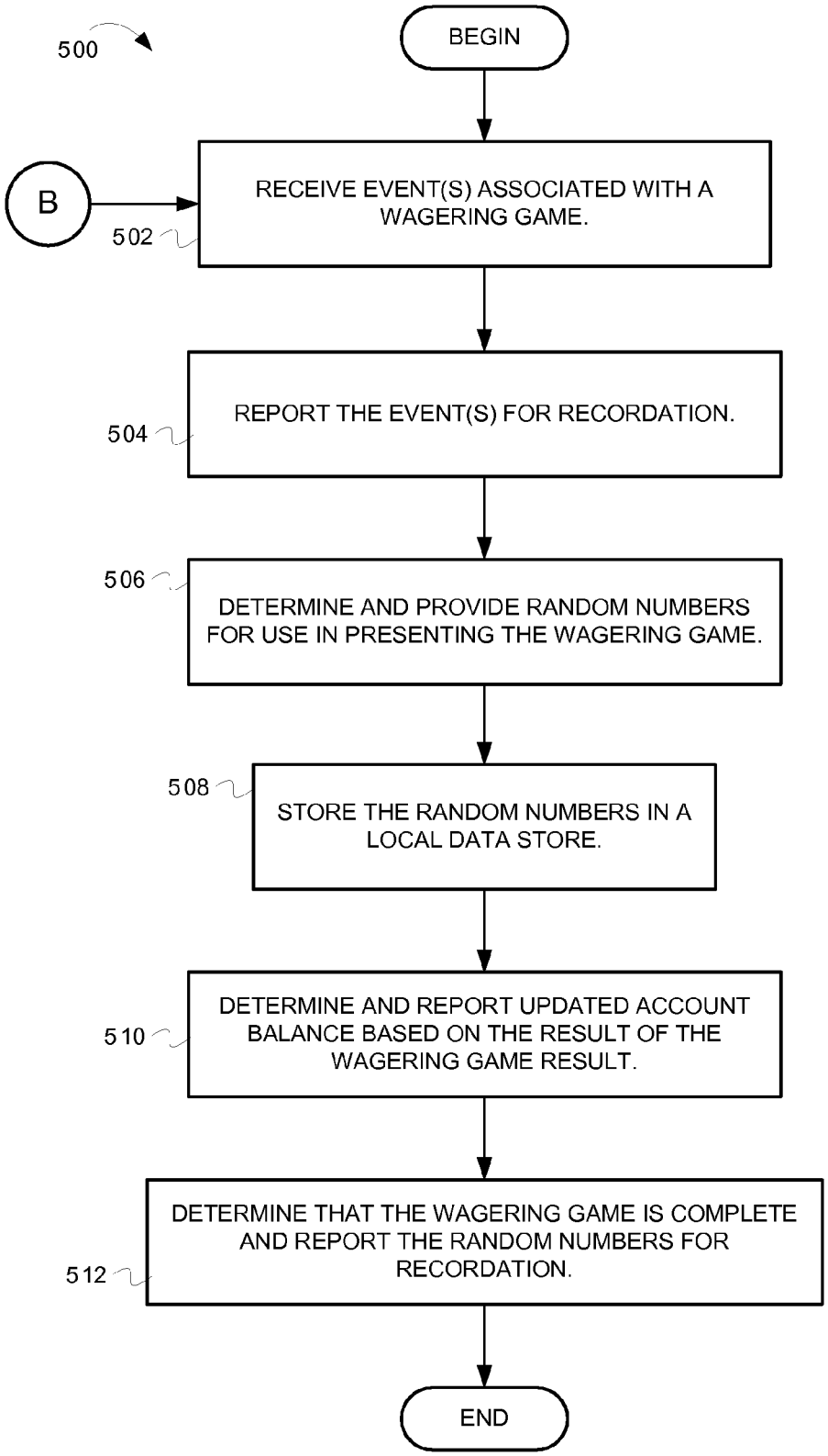
FIG. 5 is a flow diagram illustrating operations for determining and reporting results for wagering game, according to some embodiments of the invention.

While FIG. 4 described operations performed by a mobile machine, FIG. 5 describes a wagering game server's role in conducting wagering games and recording events. FIG. 5 is a flow diagram illustrating operations for determining and reporting results for a wagering game, according to some embodiments of the invention. The flow 500 begins at block 502.

At block 502, the wagering game server's game engine 244 receives events associated with a wagering game. The events can include an indication of player input received at a mobile machine 102. For example, the events can indicate that a player has pressed a "bet $5" button or a "spin reels" button. The flow continues at block 504.

At block 504, the wagering game server's game engine 244 reports the events to the game history server 249 for recordation. The flow continues at block 506.

At block 506, the game engine 244 selects and provides random number information to a mobile machine 102 for use in presenting a result for the wagering game. The random number information can indicate a result for the wagering game. The flow continues at block 508.

At block 508, the wagering game server's game engine 244 stores a copy of the random number information in a local data store. Because the random number information indicates a game result that may not have been presented (e.g., if the mobile machine 102 malfunctions before presenting the results), the game engine 244 can encrypt the random numbers. In other embodiments, the game engine 244 stores the random number information in a secure memory space that is inaccessible without proper security credentials.

In some embodiments, instead of storing the random numbers locally, the game engine 244 transmits the random number information to the game history server 249. In some embodiments, the game engine 244 encrypts the random numbers before transmission. The flow continues at block 510.

At block 510, the game engine 244 determines an updated account balance based on the game results (indicated by the random number information). Additionally, the game engine 244 reports the updated account balance to the mobile machine 102. In some embodiments, the game engine 244 notifies the account server 245 of the game result and receives an updated account balance from the account server 245. In turn, the game engine 244 can report the updated account balance to the mobile machine (see also discussion of block 412). The flow continues at block 512.

At block 512, the game engine 244 determines that the wagering game is complete and reports the random number information for recordation. In some embodiments, the game engine 244 determines the game is complete after receiving an event indicating that the mobile machine 102 presented the wagering game results (see block 414). Embodiments of the wagering game server 241 that do not store the random numbers in a local data store may not perform the operation at block 512 (see discussion of block 508). From block 512, the flow ends.

This subsection continues with a discussion of how some game history servers can record events that indicate wagering game progress.

Figure 6:
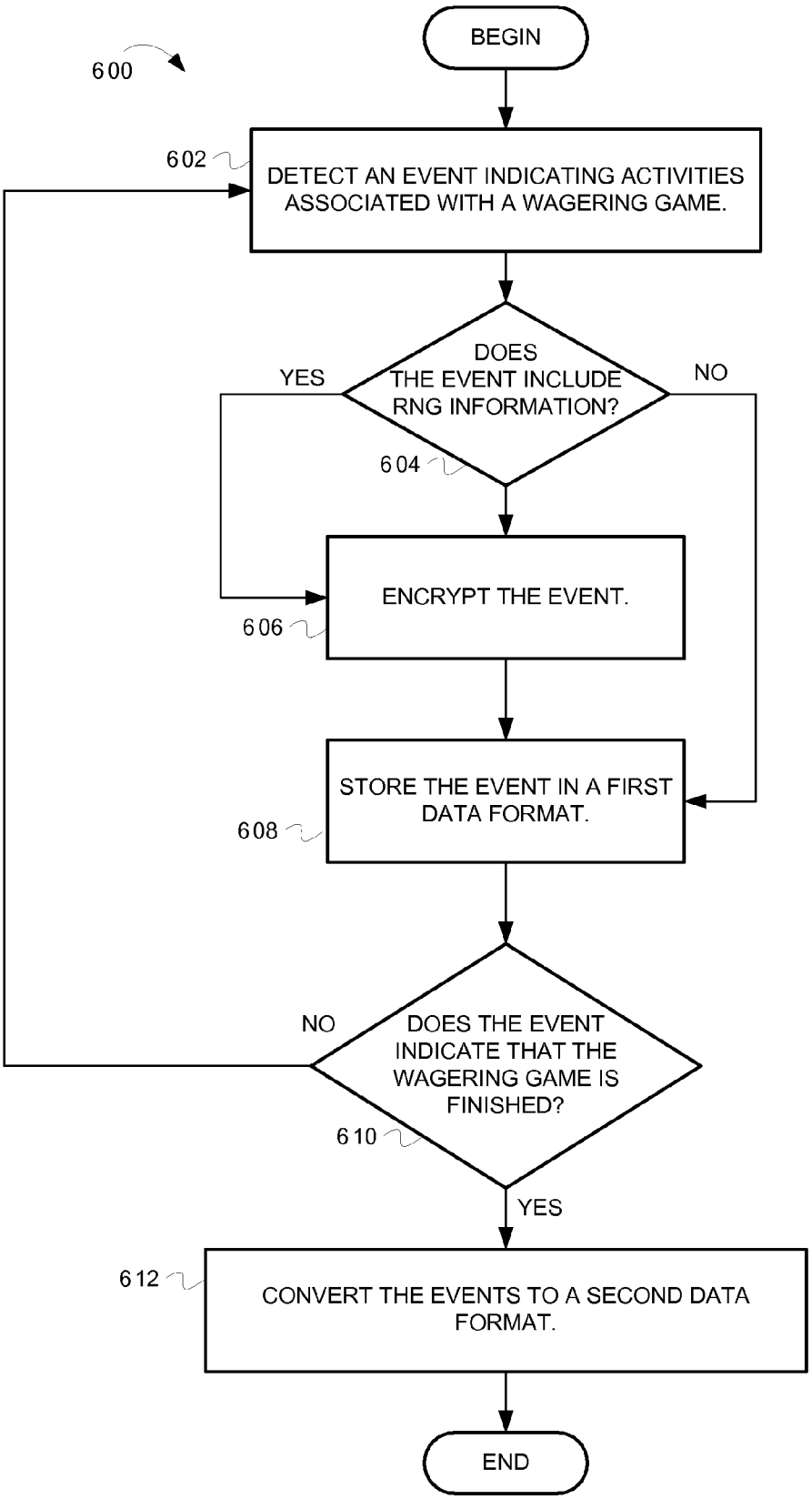
FIG. 6 is a flow diagram illustrating operations for recording events associated with the wagering game, according to some embodiments of the invention.

FIG. 6 is a flow diagram illustrating operations for recording events associated with the wagering game, according to some embodiments of the invention. The flow 600 begins at block 602.

At block 602, the game history server's event recorder 252 detects an event indicating activities associated with a wagering game. The events can indicate bets, reel spins, game piece selections, and other activities associated with wagering games. The event can be represented in any suitable format, such as a database record, programming language data structure, etc. The flow continues at block 604.

At block 604, the event recorder 252 determines whether the event includes random number information (see also discussion of blocks 508 & 512). If the event includes random number information, the flow continues at block 606. Otherwise, the flow continues at block 608.

At block 606, because the event includes random number information, the event recorder 252 encrypts the event. As noted above, the random number information can indicate intermediate or final results of a wagering game. If a rogue player learns the random number information before the game's results are presented, the player could gain an unfair advantage or commit other types of fraud. As a result, the game history server's event recorder 252 encrypts, or otherwise makes inaccessible, the events that include random number information. The flow continues at block 608.

At block 608, the event recorder 252 stores the event in a first data format. The first data format can be an uncompressed normalized format. As a result, in some embodiments, events stored in the first data format are readable to casino attendants, unless they are encrypted. The flow continues at block 610.

At block 610, the event recorder 252 determines whether the event indicates that the wagering game is finished. In some embodiments, an event indicating that a mobile machine presented game results is an event indicating the game is finished. If the wagering game is finished, the flow continues at block 612. Otherwise, the flow continues at block 602.

At block 612, the event recorder 252 converts the events associated with the wagering game to a second data format. In some embodiments, the second data format is a compressed format suitable for archiving the events. In some embodiments, the second data format requires less storage space, but is not readable by casino attendants. Because the wagering game has finished, the game history server 249 will not need the events to recover from an unfinished game. As a result, before converting to the second data format, the event recorder 252 may decrypt events that include random number information. From block 612, the flow ends.

The discussion above describes how mobile machines, wagering game servers, and game history servers can conduct wagering games and record events. This discussion continues with a description of how accounting servers interact with those components.

Figure 7:
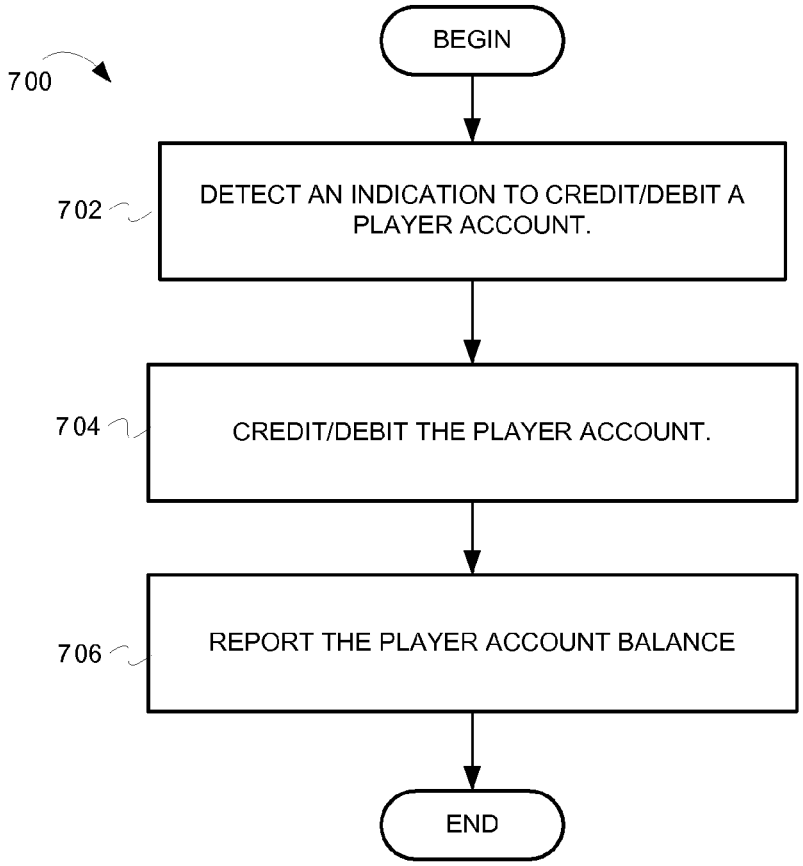
FIG. 7 is a flow diagram illustrating operations for processing account transactions associated with a wagering game, according to some embodiments of the invention.

FIG. 7 is a flow diagram illustrating operations for processing account transactions associated with a wagering game, according to some embodiments of the invention. The flow 700 begins at block 702.

At block 702, the account server's transaction manager 248 detects an indication to credit or debit a player account. In some embodiments, the account server 245 receives a credit or debit request from the wagering game server 241. The flow continues at block 704.

At block 704, the account server's transaction manager 248 debits or credits a player account. The flow continues at block 706.

At block 706, the account server's transaction manager 248 reports the player account's new balance to the wagering game server 241 or other network components. From block 706, the flow ends.

In some embodiments, although not shown in FIG. 7, the account server 245 can respond to other transaction requests, such as funds transfers, balance inquiries, deposits, withdrawals, etc.

Finishing Unfinished Wagering Games

Figure 8:
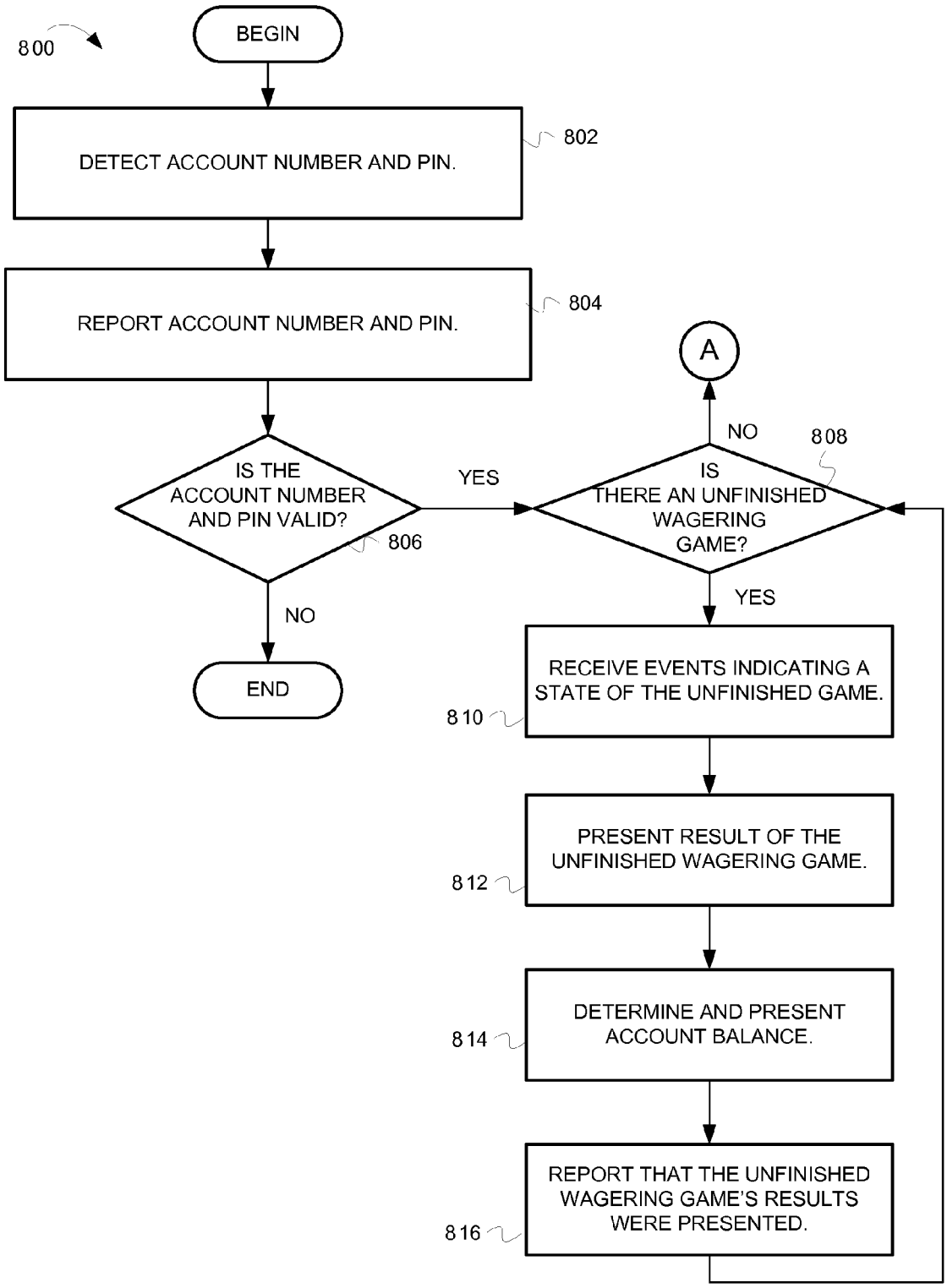
FIG. 8 is a flow diagram illustrating operations for finishing unfinished wagering games, according to some embodiments of the invention.
Figure 9:
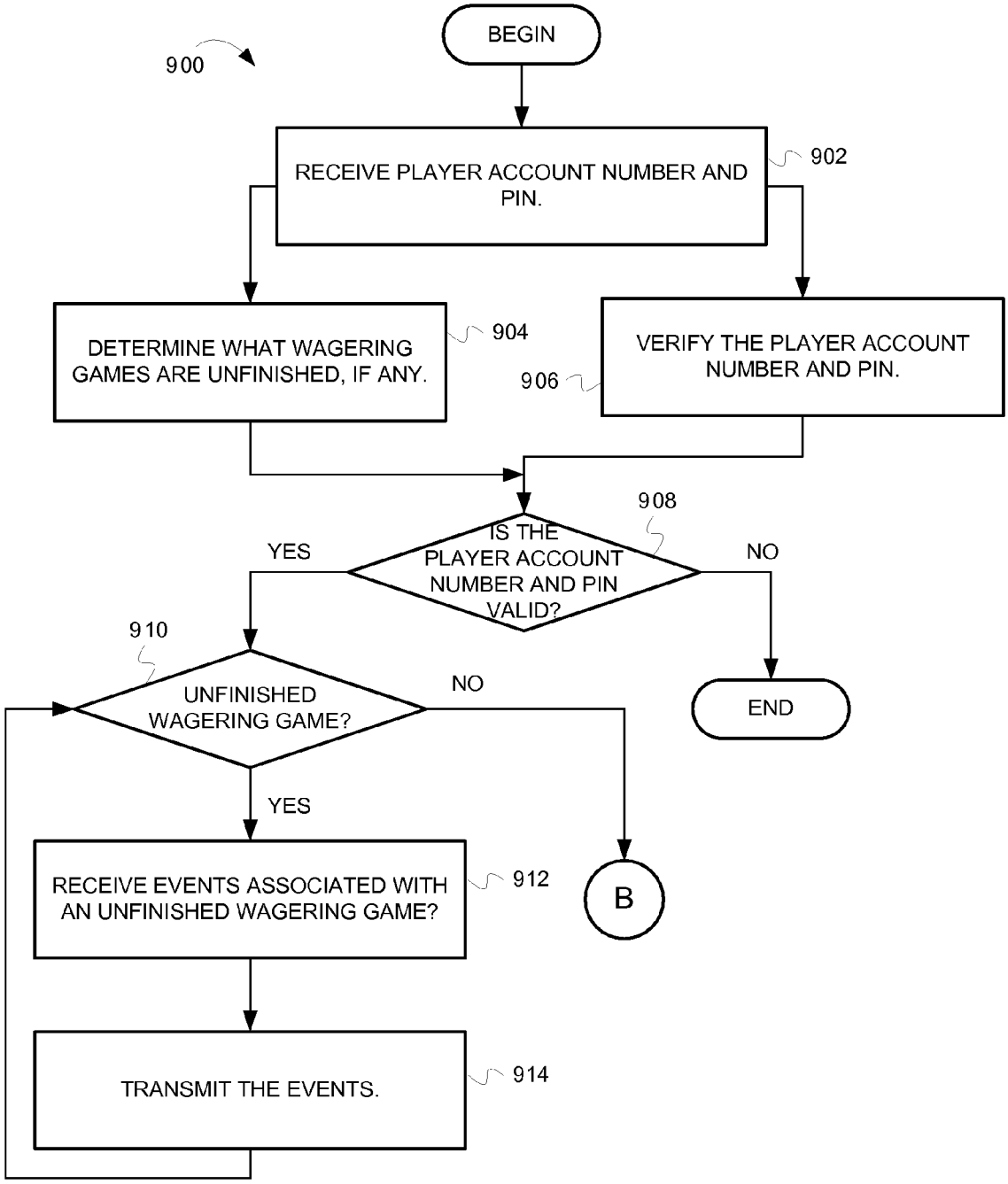
FIG. 9 is a flow diagram checking for unfinished wagering games and verifying player account, according to some embodiments of the invention.
Figure 10:
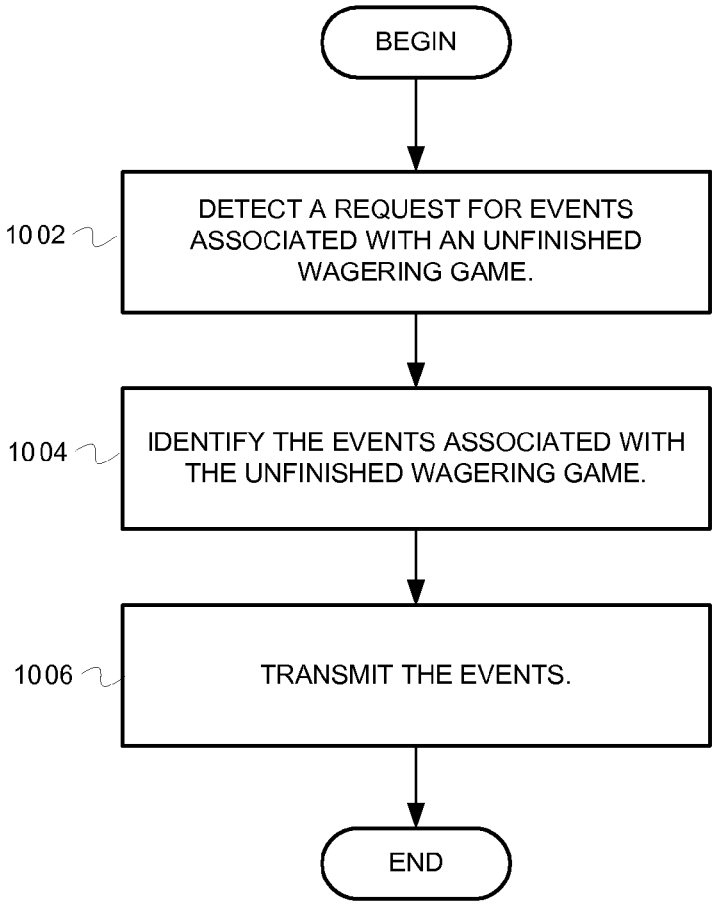
FIG. 10 is a flow diagram illustrating operations for providing game history information, according to some embodiments of the invention.

As noted above, wagering games may be interrupted for numerous reasons, such as power loss, hardware/software failure, communication loss, etc. The following discussion of FIGS. 8-10 shows how the different network components facilitate completion of unfinished wagering games. FIG. 8 shows operations for a wagering game machine, while FIGS. 9-10 show operations for a wagering game server and game history server, respectively. Although this description shows certain components performing particular operations, in other embodiments, those operations can be performed by other components.

FIG. 8 is a flow diagram illustrating operations for finishing unfinished wagering games, according to some embodiments of the invention. The flow 800 begins at block 802. At block 802, a mobile machine's wagering game unit 332 detects an account identifier (e.g., account number) and personal identification number (PIN). In some embodiments, the mobile machine detects other authentication credentials, such as biometric information, etc. In some embodiments, the mobile machine 102 reads the account identifier as a player swipes a player account card. The mobile machine 102 can detect the PIN through a button panel, keypad, or touchscreen. The flow continues at block 804.

At block 804, the mobile machine's wagering game unit 332 reports the account identifier and PIN to the wagering game server 241. The wagering game server 241 will use the account identifier and PIN to authenticate the player and initiate a wagering game session (see discussion of FIG. 9 below). The flow continues at block 806.

At block 806, the mobile machine's wagering game unit 332 determines whether the account identifier and PIN are valid. In some embodiments, the mobile machine 102 forwards the account identifier and PIN to the wagering game server 241 for determining validity. The wagering game server 241 can respond, indicating validity (see discussion of FIG. 9). If the account identifier is not valid, the flow ends. Otherwise, the flow continues at block 808.

At block 808, the wagering game unit 332 determines whether there is an unfinished wagering game. In some embodiments, the mobile machine 102 queries the wagering game server 241 about unfinished games. If there are no unfinished wagering games, the flow continues at "A", which proceeds at block 402 of FIG. 4. Otherwise, the flow continues at block 810.

At block 810, the wagering game unit 332 receives events that indicate a state for an unfinished wagering game. In some embodiments, the mobile machine 102 receives the events from the wagering game server 241 and/or the game history server 249. The events can indicate a result for the wagering game. Based on the events, wagering game unit 332 can output content (e.g., graphics, sound, etc.) that orients the game's elements, meters, etc. as they were before the interruption. For example, using the events, the wagering game unit 332 can orient cards and bet meters for a video blackjack game. Similarly, wagering game unit 332 can orient slot reels, a roulette wheel, etc. as they were before the wagering game was interrupted.

At block 812, wagering game unit 332 presents a result for the unfinished wagering game. For a slots game, the wagering game unit 332 presents spinning reels. For some other wagering game types, play continues from the interrupted state, where the wagering game unit 332 resumes reporting events and receiving intermediate game results. Eventually, the wagering game unit 332 presents final results for the unfinished wagering. The flow continues at block 814.

At block 814, the wagering game unit 332 determines and presents an account balance. In some embodiments, the wagering game unit 332 requests and receives an updated account balance (i.e., an account balance reflecting the game result) from the account server 245 or other network device. The flow continues at block 816.

At block 816, wagering game unit 332 reports to the game history server 249 or wagering game server 241 that the wagering game's results were presented. From block 816, the flow continues at block 808.

This section continues with a description of how wagering game servers can assist in resolving unfinished wagering games.

FIG. 9 is a flow diagram checking for unfinished wagering games and verifying player account information, according to some embodiments of the invention. The flow 900 begins at block 902. At block 902, the wagering game server's login manager 242 receives a player's account identifier and PIN from a mobile machine 102. In some embodiments, the login manager 242 receives other suitable authentication credentials. The flow 900 continues in parallel at blocks 904 and 906.

At block 904, the wagering game server's game engine 244 determines what, if any, wagering games are unfinished. In some embodiments, the game engine 244 queries the game history server 249 for unfinished wagering games associated with the player's account identifier. The game history server 249 indicates what games are unfinished, if any.

At block 906, the wagering game server's login manager 242 verifies the player's account identifier and PIN. In some embodiments, the login manager 242 transmits the player account identifier and PIN to the account server 245 for verification. In turn, the account server 245 indicates whether the account identifier and PIN are valid. From block 906, the flow continues at block 908.

As shown, some embodiments of the wagering game server can verify player account information and determine unfinished games in parallel or virtual parallel. Performing these operations in parallel quickens the wagering game server's response time, thus increasing the velocity of play.

At block 908, if the account identifier and PIN are not valid, the flow ends. Otherwise, the flow continues at block 910.

At block 910, if there are no unfinished games, the flow continues at "B", which flows into block 502 of FIG. 5. Otherwise, the flow continues at block 912.

At block 912, the wagering game server's game engine 244 receives events associated with an unfinished wagering game. In some embodiments, the game engine 244 requests from the game history server 249 events for the unfinished wagering game identified at block 904. The events can indicate game state, intermediate results, and final results. The flow continues at block 914.

At block 914, the game engine 244 transmits the events to a mobile machine 102, which can process the events as described in FIG. 8. From block 914, the flow continues at block 910.

While FIGS. 8 & 9 describe how some mobile machines and wagering game servers cooperate in resolving unfinished wagering games, the discussion will turn to how game history servers can assist in resolving unfinished wagering games.

FIG. 10 is a flow diagram illustrating operations for providing game history information, according to some embodiments of the invention. The flow 1000 begins at block 1002. At block 1002, the game history server's recovery manager 250 detects a request for events associated with an unfinished wagering game. The request may originate from a wagering game server. The flow continues at block 1004.

At block 1004, the recovery manager 250 identifies events associated with the unfinished wagering game. Some events may include encrypted information, such as random number information. The recovery manager 250 may decrypt any encrypted information. The flow continues at block 1006.

At block 1006, recovery manager 250 transmits the events to a device on the wagering game network (e.g., a wagering game server). From flow 1006, the flow ends.

Although not shown in FIG. 10, the game history server 249 can respond to inquiries about whether a particular player account has unfinished wagering games. To facilitate this, events can include information such as player account identifier, wagering game identifier, wagering game machine, time, casino, etc. The recovery manager 250 can search for unfinished game events using player account identifiers or other information.

Resolving Unfinished Games

Although embodiments of the invention facilitate finishing unfinished wagering games, some wagering games remain unfinished for long time periods. In some instances, wagering game may go unfinished because players are vacationing when their games are interrupted. If players end their vacation before finishing their interrupted games, those games may remain unfinished forever. As the number of unfinished games grows, game history servers and other components expend more resources tracking unfinished games. Additionally, unfinished games tie up monies that could be profits. As a result, some embodiments of the invention resolve unfinished wagering games without needing further interaction from players.

Figure 11:
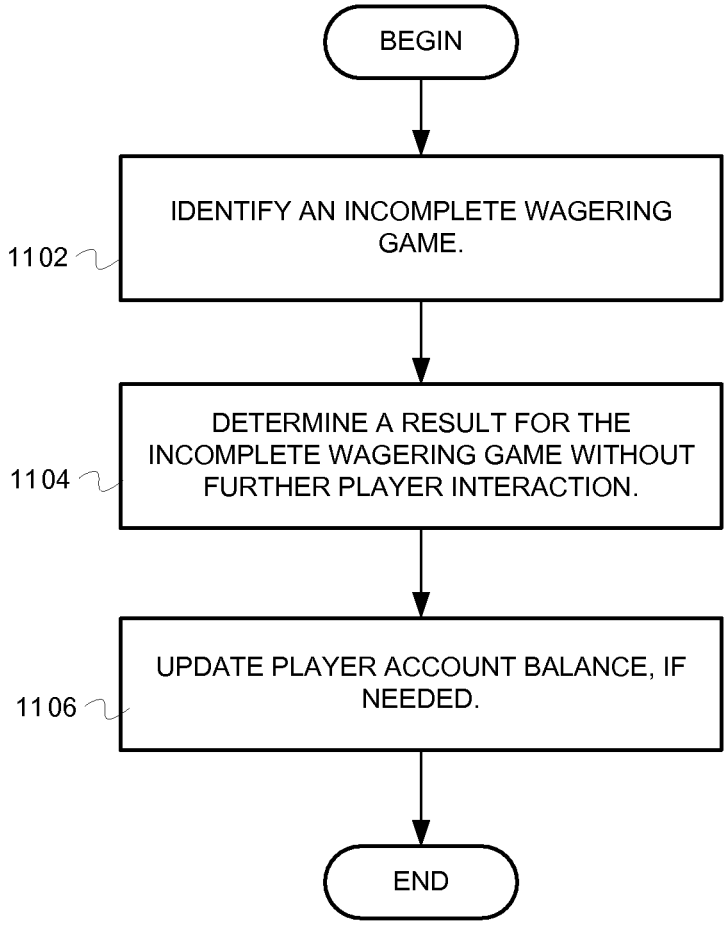
FIG. 11 is a flow diagram illustrating operations for resolving unfinished wagering games without player input, according to some embodiments of invention.

FIG. 11 is a flow diagram illustrating operations for resolving unfinished wagering games without player input, according to some embodiments of invention. The flow 1100 begins at block 1102. At block 1102, the game history server's wagering game resolution unit ("resolution unit) 254 identifies an incomplete wagering game. In some embodiments, the resolution unit 254 can identify incomplete games based on various criteria, such as time, game type, player account, casino, wagering game machine model, etc. For example, the resolution unit 254 can identify wagering games that have been incomplete for more than one month. The flow continues at block 1104.

At block 1104, the resolution unit 254 determines a result for the incomplete wagering game without further player interaction. For example, the resolution unit 254 can determine whether a player wins or loses the player's wager. In instances where the incomplete wagering game's events indicate a final result, the resolution unit 254 can use the result. In other instances, where the events do not indicate a final result, the resolution unit 254 can apply rules to determine results. The rules can comport with government regulations or casino policies for resolving unfinished wagering games. For example, the resolution unit 254 can apply a state gaming commission's rules that enumerate conditions under which unfinished games result in refunds, player awards, and retained monies. The resolution unit 254 can have different resolution rules for each game type. The flow continues at block 1106.

At block 1106, if needed, the resolution unit 254 updates an associated player account based on the result. For example, the resolution unit 254 can credit a player account for wager amounts or other suitable amounts. In other instances, the resolution unit 254 does not change the account balance because a wager was already withdrawn from the account. From block 1106, the flow ends.

More About Mobile Machines

Figure 12:
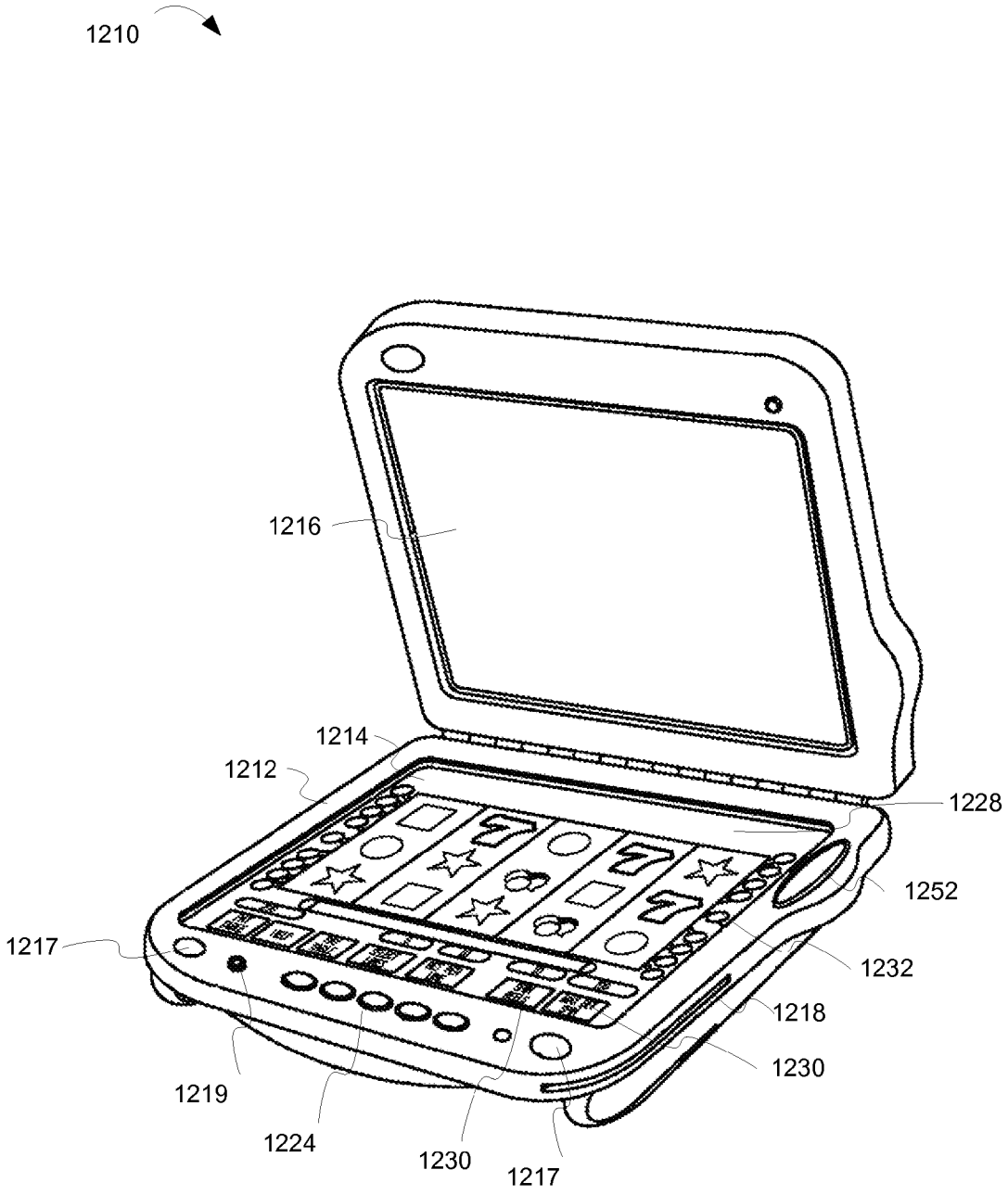
FIG. 12 shows an example embodiment of a wagering game machine, according to some embodiments of the invention.

FIG. 12 shows an example embodiment of a wagering game machine, according to some embodiments of the invention. Like free standing wagering game machines, in a handheld or mobile form, the wagering game machine 1210 can include any suitable electronic device configured to play a video casino games such as blackjack, slots, keno, poker, blackjack, and roulette. The wagering game machine 1210 comprises a housing 1212 and includes input devices, including a value input device 1218 and a player input device 1224. For output, the wagering game machine 1210 includes a primary display 1214, a secondary display 1216, one or more speakers 1217, one or more player-accessible ports 1219 (e.g., an audio output jack for headphones, a video headset jack, etc.), and other conventional I/O devices and ports, which may or may not be player-accessible. In the embodiment depicted in FIG. 12, the wagering game machine 1210 comprises a secondary display 1216 that is rotatable relative to the primary display 1214. The optional secondary display 1216 can be fixed, movable, and/or detachable/attachable relative to the primary display 1214. Either the primary display 1214 and/or secondary display 1216 can be configured to display any aspect of a non-wagering game, wagering game, secondary game, bonus game, progressive wagering game, group game, shared-experience game or event, game event, game outcome, scrolling information, text messaging, emails, alerts or announcements, broadcast information, subscription information, and wagering game machine status.

The player-accessible value input device 1218 can comprise, for example, a slot located on the front, side, or top of the housing 1212 configured to receive credit from a stored-value card (e.g., casino card, smart card, debit card, credit card, etc.) inserted by a player. The player-accessible value input device 1218 can also comprise a sensor (e.g., an RF sensor) configured to sense a signal (e.g., an RF signal) output by a transmitter (e.g., an RF transmitter) carried by a player. The player-accessible value input device 1218 can also or alternatively include a ticket reader, or barcode scanner, for reading information stored on a credit ticket, a card, or other tangible portable credit or funds storage device. The credit ticket or card can also authorize access to a central account, which can transfer money to the wagering game machine 1210.

Still other player-accessible value input devices 1218 can require the use of touch keys 1230 on the touch-screen display (e.g., primary display 1214 and/or secondary display 1216) or player input devices 1224. Upon entry of player identification information and, preferably, secondary authorization information (e.g., a password, PIN number, stored value card number, predefined key sequences, etc.), the player can be permitted to access a player's account. As one potential optional security feature, the wagering game machine 1210 can be configured to permit a player to only access an account the player has specifically set up for the wagering game machine 1210. Other conventional security features can also be utilized to, for example, prevent unauthorized access to a player's account, to minimize an impact of any unauthorized access to a player's account, or to prevent unauthorized access to any personal information or funds temporarily stored on the wagering game machine 1210.

The player-accessible value input device 1218 can itself comprise or utilize a biometric player information reader which permits the player to access available funds on a player's account, either alone or in combination with another of the aforementioned player-accessible value input devices 1218. In an embodiment wherein the player-accessible value input device 1218 comprises a biometric player information reader, transactions such as an input of value to the wagering game machine 1210, a transfer of value from one player account or source to an account associated with the wagering game machine 1210, or the execution of another transaction, for example, could all be authorized by a biometric reading, which could comprise a plurality of biometric readings, from the biometric device.

Alternatively, to enhance security, a transaction can be optionally enabled only by a two-step process in which a secondary source confirms the identity indicated by a primary source. For example, a player-accessible value input device 1218 comprising a biometric player information reader can require a confirmatory entry from another biometric player information reader 1252, or from another source, such as a credit card, debit card, player ID card, fob key, PIN number, password, hotel room key, etc. Thus, a transaction can be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds.

In another aspect, the value input device 1218 can be provided remotely from the wagering game machine 1210.

The player input device 1224 comprises a plurality of push buttons on a button panel for operating the wagering game machine 1210. In addition, or alternatively, the player input device 1224 can comprise a touch screen mounted to a primary display 1214 and/or secondary display 1216. In one aspect, the touch screen is matched to a display screen having one or more selectable touch keys 1230 selectable by a user's touching of the associated area of the screen using a finger or a tool, such as a stylus pointer. A player enables a desired function either by touching the touch screen at an appropriate touch key 1230 or by pressing an appropriate push button on the button panel. The touch keys 1230 can be used to implement the same functions as push buttons. Alternatively, the push buttons 1226 can provide inputs for one aspect of the operating the game, while the touch keys 1230 can allow for input needed for another aspect of the game. The various components of the wagering game machine 1210 can be connected directly to, or contained within, the casing 1212, as seen in FIG. 12, or can be located outside the casing 1212 and connected to the housing 1212 via a variety of wired (tethered) or wireless connection methods. Thus, the wagering game machine 1210 can comprise a single unit or a plurality of interconnected (e.g., wireless connections) parts which can be arranged to suit a player's preferences.

The operation of the basic wagering game on the wagering game machine 1210 is displayed to the player on the primary display 1214. The primary display 1214 can also display the bonus game associated with the basic wagering game. The primary display 1214 preferably takes the form of a high resolution LCD, a plasma display, an LED, or any other type of display suitable for use in the wagering game machine 1210. The size of the primary display 1214 can vary from, for example, about a 2-3" display to a 15" or 17" display. In at least some embodiments, the primary display 1214 is a 7"-10" display. In some embodiments, the size of the primary display can be increased. Optionally, coatings or removable films or sheets can be applied to the display to provide desired characteristics (e.g., anti-scratch, anti-glare, bacterially-resistant and anti-microbial films, etc.). In at least some embodiments, the primary display 1214 and/or secondary display 1216 can have a 16:9 aspect ratio or other aspect ratio (e.g., 4:3). The primary display 1214 and/or secondary display 1216 can also each have different resolutions, different color schemes, and different aspect ratios.

As with the free standing embodiments a wagering gaming machine, a player begins play of the basic wagering game on the wagering game machine 1210 by making a wager (e.g., via the value input device 1218 or an assignment of credits stored on the handheld gaming machine via the touch screen keys 1230, player input device 1224, or buttons 1226) on the wagering game machine 1210. In some embodiments, the basic game can comprise a plurality of symbols arranged in an array, and includes at least one payline 1232 that indicates one or more outcomes of the basic game. Such outcomes can be randomly selected in response to the wagering input by the player. At least one of the plurality of randomly selected outcomes can be a start-bonus outcome, which can include any variations of symbols or symbol combinations triggering a bonus game.

In some embodiments, the player-accessible value input device 1218 of the wagering game machine 1210 can double as a player information reader 1252 that allows for identification of a player by reading a card with information indicating the player's identity (e.g., reading a player's credit card, player ID card, smart card, etc.). The player information reader 1252 can alternatively or also comprise a bar code scanner, RFID transceiver or computer readable storage medium interface. In some embodiments, the player information reader 1252 comprises a biometric sensing device.

General

This description describes numerous details about embodiments of the invention. However, some embodiments may be practiced without these specific details. In some instances, for sake of clarity, this description omits well-known circuits, structures, and techniques. In this description, references to "one embodiment" or "an embodiment" mean that a feature is included in at least one embodiment of the invention. Furthermore, separate references to "one embodiment" do not necessarily refer to the same embodiment. Thus, the present invention can include any combination the embodiments described herein.

The invention claimed is:

1. A method for resolving an unfinished wagering game, the method comprising:

detecting a first group of events associated with a wagering game being presented at a wagering game machine, wherein the events include a financial transaction on a player account;

detecting a second group of events associated with the wagering game, wherein the second group of events includes random number information indicating an intermediate result for the wagering game, wherein the random number information originates outside the wagering game machine;

determining, based on one or more events in the first and second groups of events, that wagering game was interrupted and that a final result has not been determined for the wagering game;

determining the final result for the wagering game, wherein the final result is determined during the interruption and without additional player input; and modifying, a balance of the player account without presenting the result on the wagering game machine, wherein the modifying is based on the final result.

2. The method of claim 1 further comprising:

storing the first group of events in a first data format;

encrypting the second group of events; and storing the second group of events in the first data format;

after modifying the balance of the player account, decrypting the second group of events; and converting the first and second groups of events into a compressed data format.

3. The method of claim 2, wherein events in the first data format and events in the compressed data format are stored in different data stores.

4. The method of claim 2, wherein the first data format is a clear text format.

5. The method of claim 2, wherein the compressed data format requires less storage space than the first data format.

6. The method of claim 2, wherein events in the first data format are in a native database format, and wherein events in the compressed data format are in an archival format.

7. The method of claim 1, wherein the first group of events further includes player input indicating one or more of a wager, a game element selection, and a game invocation.

8. A machine-readable storage device including instructions executable by a machine, the instructions comprising:

instructions for receiving, via a wagering game network, a player account identifier associated with a player account and one or more authentication credentials;

instructions for verifying the authentication credentials;

determining there is an unfinished wagering game associated with the player account identifier; and instructions for procuring, via the wagering game network, one or more events associated with the unfinished wagering game, wherein the one or more events include information about the progress of the unfinished wagering game, and wherein a final result has not been determined for the unfinished wagering game;

instructions for determining the final result of the unfinished wagering game without additional player input, wherein the determining the final result is based on rules for unfinished games; and instructions for crediting the player account based on the final result.

9. The machine-readable medium of claim 8, the instructions further comprising:

instructions for causing presentation of the final result for the unfinished wagering game on a wagering game machine.

10. The machine-readable medium of claim 8, wherein the one or more events indicate player input associated with the unfinished wagering game.

11. The machine-readable medium of claim 8, the instructions further comprising:

instructions for transmitting, to a wagering game machine, the one or more events for use in presenting the final result for the unfinished wagering game.

12. The machine-readable medium of claim 8, wherein the events indicate player inputs that have been detected and content that has been presented.

13. A wagering game network comprising:

a wagering game machine configured to report events associated with a wagering game and a player account;

a wagering game server configured to generate random number information in response to one or more of the events, wherein the random number information indicates a result for the wagering game;

a game history server including, an event recorder configured to record the events and the random number information; and a wagering game resolution unit configured to determine, based on the events, that the wagering game was interrupted and that a final result of the wagering game has not been determined;

determine the final result of the wagering game without further player input; and cause modification of a balance of the player account based on the result.

14. The wagering game network of claim 13, wherein the wagering game server and game history server are included in a single device.

15. The wagering game network of claim 13, wherein the wagering game server and game history server are separate devices of the wagering game network.

16. The wagering game network of claim 13 further comprising:

an account server configured to perform the modification of the balance of the player account.

17. The wagering game network of claim 13, wherein the events indicate one or more selected from the set consisting of a wager, a game element selection, and a game invocation.

18. The wagering game network of claim 13, wherein the wagering game machine is a mobile model.

19. The wagering game network of claim 13, wherein the game history sever is further configured to encrypt the random number information.

* * * * *